US008758076B1

(12) United States Patent
Austin

(10) Patent No.: US 8,758,076 B1
(45) Date of Patent: Jun. 24, 2014

(54) RADIO CONTROLLED TOY FOR FREE FORM DRAWING

(76) Inventor: Gwen Austin, Denver, CO (US)

( * ) Notice: Subject to any disclaimer, the term of this patent is extended or adjusted under 35 U.S.C. 154(b) by 290 days.

(21) Appl. No.: 11/496,929

(22) Filed: Jul. 31, 2006

(51) Int. Cl.
*A63H 13/15* (2006.01)

(52) U.S. Cl.
USPC ..... 446/146; 446/175; 446/454

(58) Field of Classification Search
USPC ..... 446/146, 465, 175, 454–456
See application file for complete search history.

(56) References Cited

U.S. PATENT DOCUMENTS

| | | | | | |
|---|---|---|---|---|---|
| 3,425,395 | A | * | 2/1969 | Cugini et al. | 118/232 |
| 3,510,949 | A | * | 5/1970 | Christy | 33/27.01 |
| 3,638,319 | A | * | 2/1972 | Barlow et al. | 33/18.1 |
| 3,648,373 | A | * | 3/1972 | Morrison et al. | 33/18.1 |
| 3,726,019 | A | * | 4/1973 | Adler | 33/18.1 |
| 4,109,412 | A | * | 8/1978 | Saito | 446/445 |
| 4,485,555 | A | * | 12/1984 | May et al. | 33/18.1 |
| 4,959,037 | A | | 9/1990 | Garfinkel | |
| 4,964,837 | A | * | 10/1990 | Collier | 446/409 |
| 5,334,076 | A | * | 8/1994 | Shinozuka | 446/456 |
| 5,752,870 | A | * | 5/1998 | Karasawa et al. | 446/146 |
| 5,895,072 | A | * | 4/1999 | Coroneos et al. | 280/811 |
| 6,074,693 | A | | 6/2000 | Manning | |
| 6,116,707 | A | | 9/2000 | Avida | |
| 6,299,934 | B1 | | 10/2001 | Manning | |
| 6,330,503 | B1 | | 12/2001 | Sharp et al. | |
| 6,648,722 | B2 | * | 11/2003 | Lynders et al. | 446/437 |
| 6,719,467 | B2 | | 4/2004 | Hess et al. | |
| 6,729,706 | B1 | | 5/2004 | Patton et al. | |
| 6,840,839 | B2 | * | 1/2005 | Rehkemper et al. | 446/454 |
| 6,951,375 | B2 | | 10/2005 | Patton et al. | |
| 7,029,199 | B2 | | 4/2006 | Mayfield et al. | |
| 2002/0123297 | A1 | * | 9/2002 | Hornsby et al. | 446/484 |
| 2004/0233242 | A1 | * | 11/2004 | Patton et al. | 347/14 |
| 2005/0003735 | A1 | * | 1/2005 | Carter et al. | 446/456 |
| 2005/0055142 | A1 | | 3/2005 | McMurtry et al. | |
| 2007/0135016 | A1 | * | 6/2007 | Ihara | 446/146 |

OTHER PUBLICATIONS http://www.scribblerrobot.com/ContentPages/Press.aspx (Oct. 25, 2004).*
http://web.archive.org/web/20051124231500/http://www.scribbler-robot.com/ContentPages/Features.aspx (Nov. 24, 2005).*

* cited by examiner

*Primary Examiner* — William Brewster
*Assistant Examiner* — Alex F. R. P. Rada, II
(74) *Attorney, Agent, or Firm* — Swanson & Bratschun, L.L.C.

(57) ABSTRACT

According to one embodiment a remote controlled drawing toy can be provided that allows a user to operate a drawing unit that couples drawing implements. For example, such a drawing unit can be used outdoors on sidewalks and driveways.

21 Claims, 16 Drawing Sheets

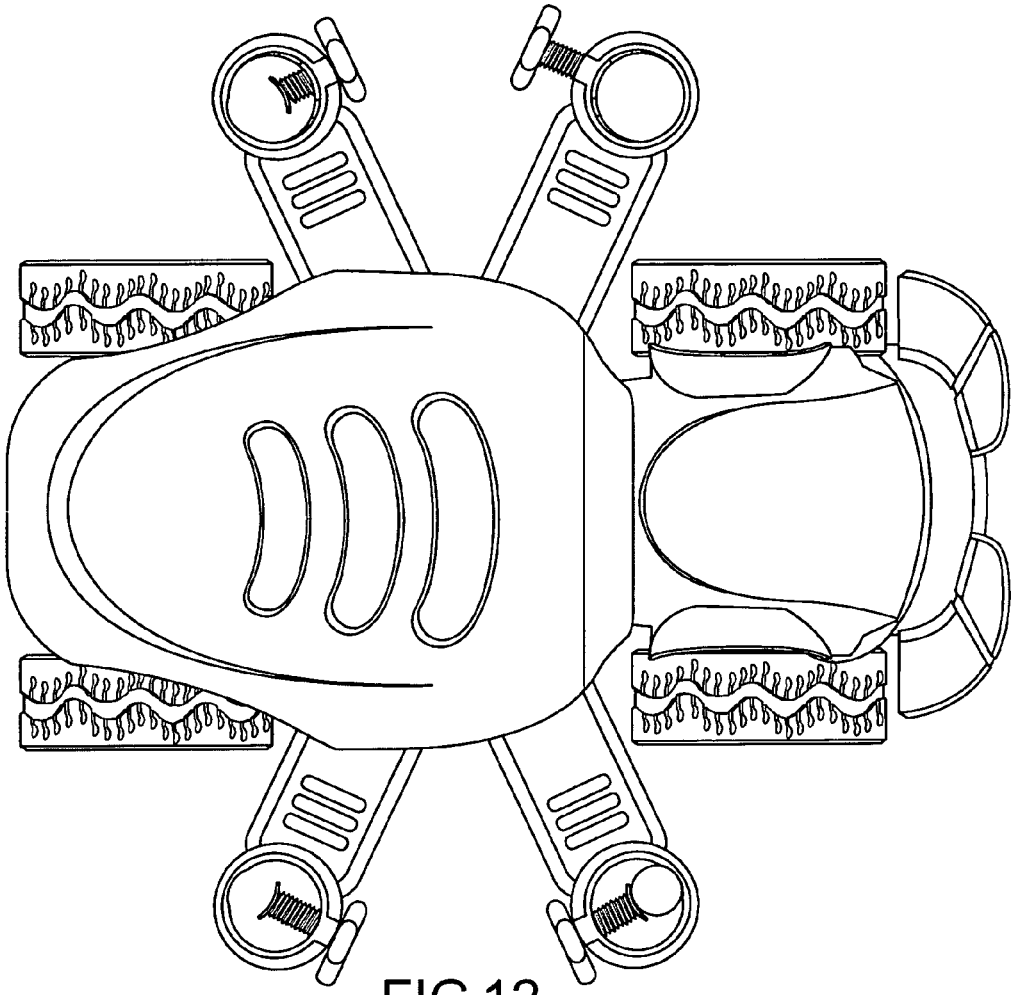
FIG.12
FIG.14
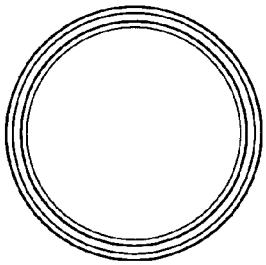
FIG.13
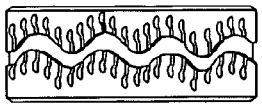

RADIO CONTROLLED TOY FOR FREE FORM DRAWING

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

One embodiment of the invention relates generally to a toy for remote controlled drawing. For example, the toy can be used for free form drawing on a large drawing surface.

BACKGROUND

Children that like to draw are limited in the media that they can use. Furthermore, their artwork is typically performed inside while sitting down at a table or easel. This limits the child's ability to utilize their natural energy to create their art. Furthermore, it typically restricts them to a limited drawing surface and most times requires them to remain inside. Thus, a child forced to choose between their artwork and going outside to play or their artwork and playing a game indoors may likely choose the more active option and neglect their artistic skills.

Furthermore, for a child that likes to be outside, there are limited artistic activities that the child can do without specialized facilities and expensive drawing media.

In addition, an active child generally prefers to be actively employed in a game or learning activity rather than sitting at a desk or easel. Therefore, for such a child it can be difficult for him or her to develop his or her skills because previous art activities have required one to remain seated or in a substantially fixed location.

Consequently, it would be desirable if there were an activity that children could do that allowed them to be active while creating their art.

SUMMARY

According to one embodiment of the invention, a toy for drawing is provided comprising a self-powered body; a receiver coupled with the self-powered body and configured to be responsive to at least one signal from a remote transmitter for controlling the self powered body; and at least one drawing implement holder coupled with the self-powered body and configured to cause the drawing implement to contact a drawing surface during operation of the toy on the drawing surface.

Yet another embodiment of the invention provides a control module for controlling a remote controlled toy, the control module comprising a memory; a processor coupled with the memory wherein the processor is configured to utilize an initiate storage signal to instruct storage of a sequence of drawing commands for a remote controlled drawing toy; and to receive the sequence of drawing commands, the drawing commands for causing the remote controlled drawing toy to draw a drawing; and to instruct storage of the sequence of drawing commands in memory for available playback to the remote controlled drawing toy at a later time so as to cause the remote controlled drawing toy to reproduce the drawing; and to utilize a cease storage signal to cause the processor to stop storing the sequence of drawing commands.

Still another embodiment of the invention provides a toy for drawing comprising a self-powered body; a receiver coupled with the self-powered body and configured to be responsive to at least one signal from a remote transmitter for controlling the self powered body; at least one wheel coupled with the self-powered body; wherein the at least one wheel is at least partially configured from chalk.

In accordance with one embodiment an apparatus is provided that comprises a substantially wheel shaped body; an axle passage formed by the substantially wheel shaped body; chalk disposed as part of the wheel shaped body; wherein the substantially wheel shaped body is configured so as to be placed on an axle of a self-powered toy device for use in drawing on a drawing surface.

In accordance with one embodiment of the invention, a method of storing drawing commands can be implemented by inputting an initiate storage command to a processor to cause the processor to begin storing a sequence of drawing commands for a remote controlled drawing toy; inputting the sequence of drawing commands to cause the remote controlled drawing toy to draw a drawing; storing the sequence of drawing commands in memory for available playback to the remote controlled drawing toy at a later time so as to cause the remote controlled drawing toy to reproduce the drawing; inputting a cease storage command to the processor to cause the processor to stop storing the sequence of drawing commands.

In accordance with yet another embodiment of the invention, a method of free form drawing on a drawing surface can be implemented that comprises configuring a toy drawing apparatus with a drawing implement; controlling the toy drawing apparatus with a remote control transmitter; and utilizing the remote control transmitter to cause the toy drawing apparatus to move across the outdoor drawing surface so as to draw a free form drawing on the drawing surface.

BRIEF DESCRIPTION OF THE DRAWINGS

FIG. 12 illustrates a top view of a drawing vehicle in accordance with one embodiment of the invention.

FIG. 13 illustrates a top view of a chalk wheel in accordance with one embodiment of the invention.

FIG. 14 illustrates a side view of a chalk wheel shown in FIG. 13 in accordance with one embodiment of the invention.

DESCRIPTION

Figure 1:
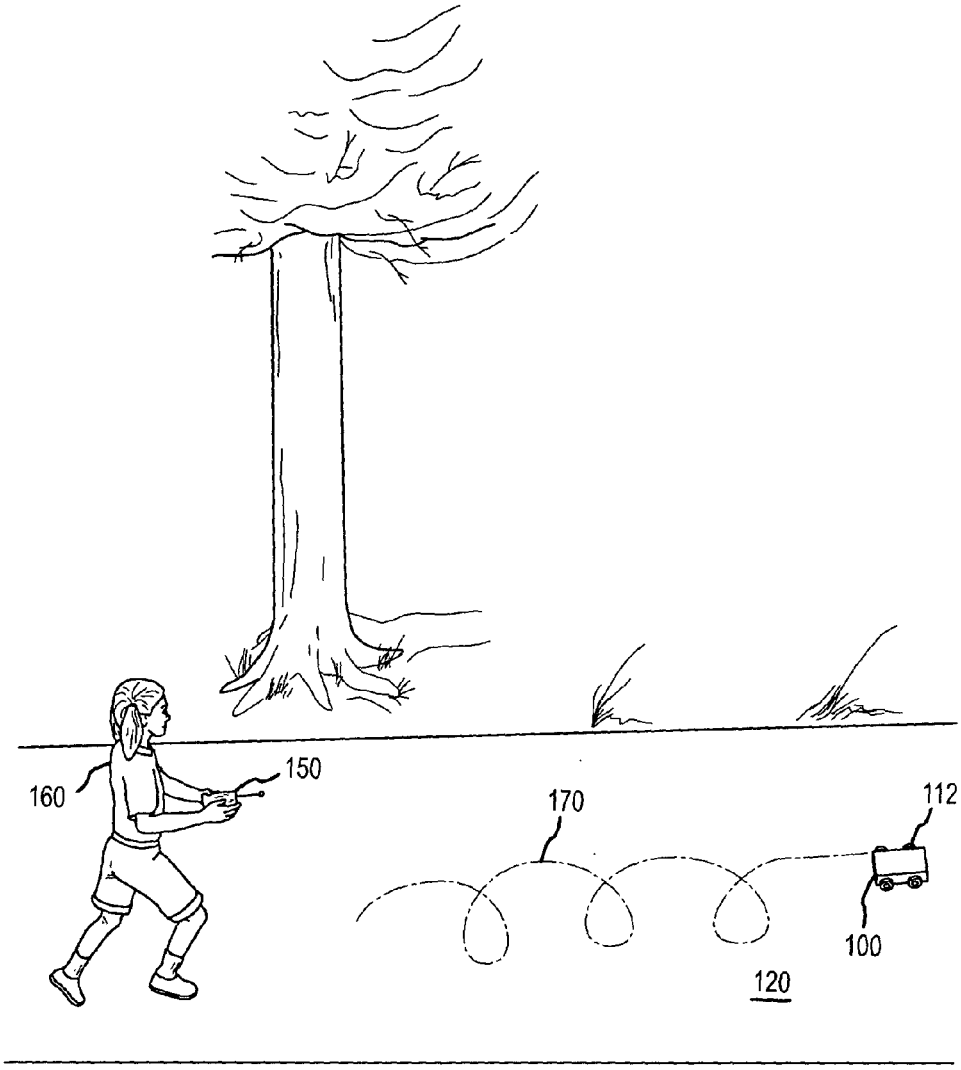
FIG. 1 illustrates a perspective view of a child utilizing a remote controlled drawing vehicle according to one embodiment of the invention.

In accordance with one embodiment of the invention, a remote controlled drawing apparatus can be utilized by a child to allow the child to make large scale drawings in a remote controlled fashion. This can be particularly useful for a child that likes to play outside in that it allows the child to draw on a driveway or sidewalk in an active fashion. In addition, it allows the child to move freely about and even stand on the drawing surface itself while creating the drawing. Furthermore, it allows complete free form drawing so that the child can create expressive art as he or she desires. But also, it introduces a playful aspect in that the drawing vehicle can take different forms such as a bug, a car, an animal, or other such form.

FIG. 1 illustrates an example of a child 160 playing outside on a driveway 120. The child is shown holding a controller 150 that remotely controls drawing vehicle 100. FIG. 1 shows that a design 170 has been created by the drawing vehicle. This can be accomplished by utilizing drawing implement holders, such as drawing implement holder 112 in FIG. 1 to hold a variety of different drawing implements. For example, a crayon, a piece of chalk, or a marker can be utilized for the drawing implements.

Figure 2:
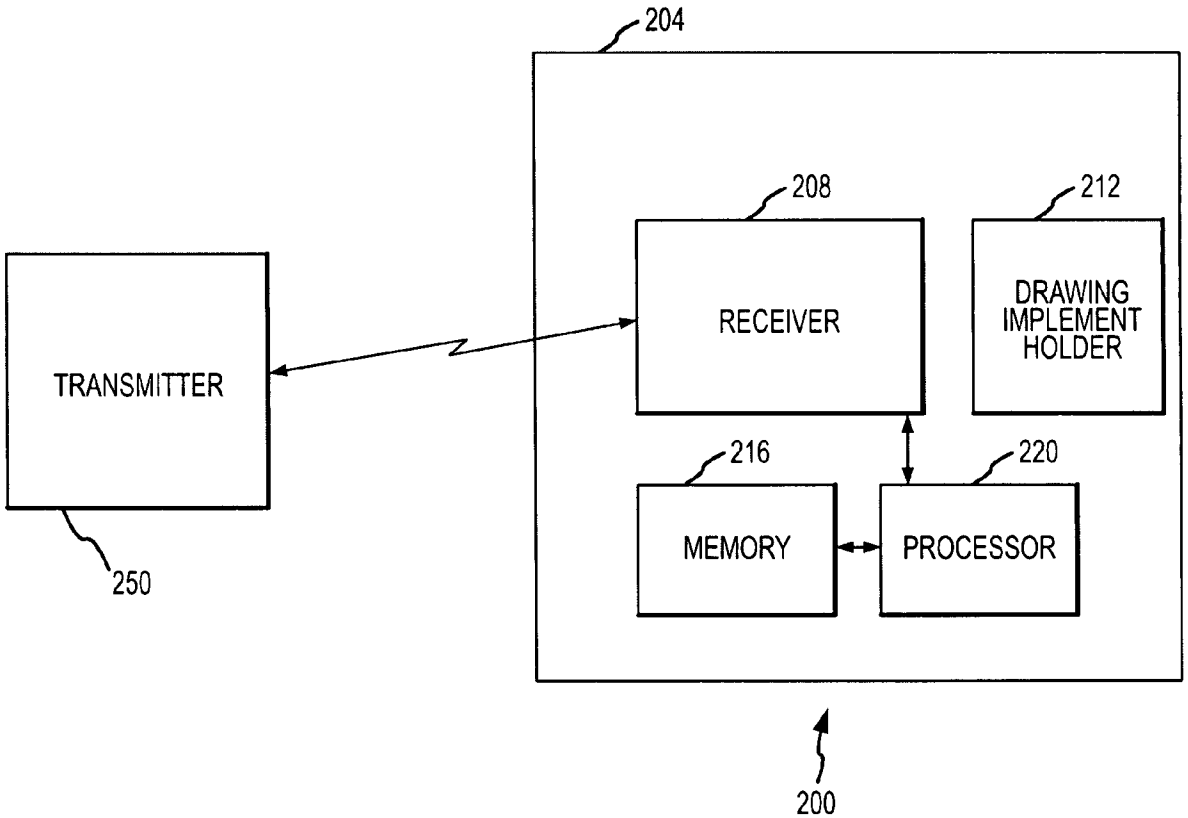
FIG. 2 illustrates a block diagram of a remote controlled drawing vehicle system according to one embodiment of the invention.

FIG. 2 illustrates an example of a transmitter controller 250 and a drawing unit 200. The drawing unit 200 is comprised of a self-powered body 204 which can be comprised of a chassis, wheels, and a power supply. The drawing unit 200 is shown as having a receiver 208 for receiving signals from the transmitter 250. In addition, a processor 220 can be coupled with the receiver for making use of the signals. A memory 216 can be coupled with the processor and can also be utilized for storing a sequence of signals. A drawing implement holder 212 is coupled with the self-powered body 204 for holding the drawing implement of choice. Signals can be transmitted from transmitter 250 to receiver 208 as would be readily understood by one of ordinary skill in the art.

Figure 3:
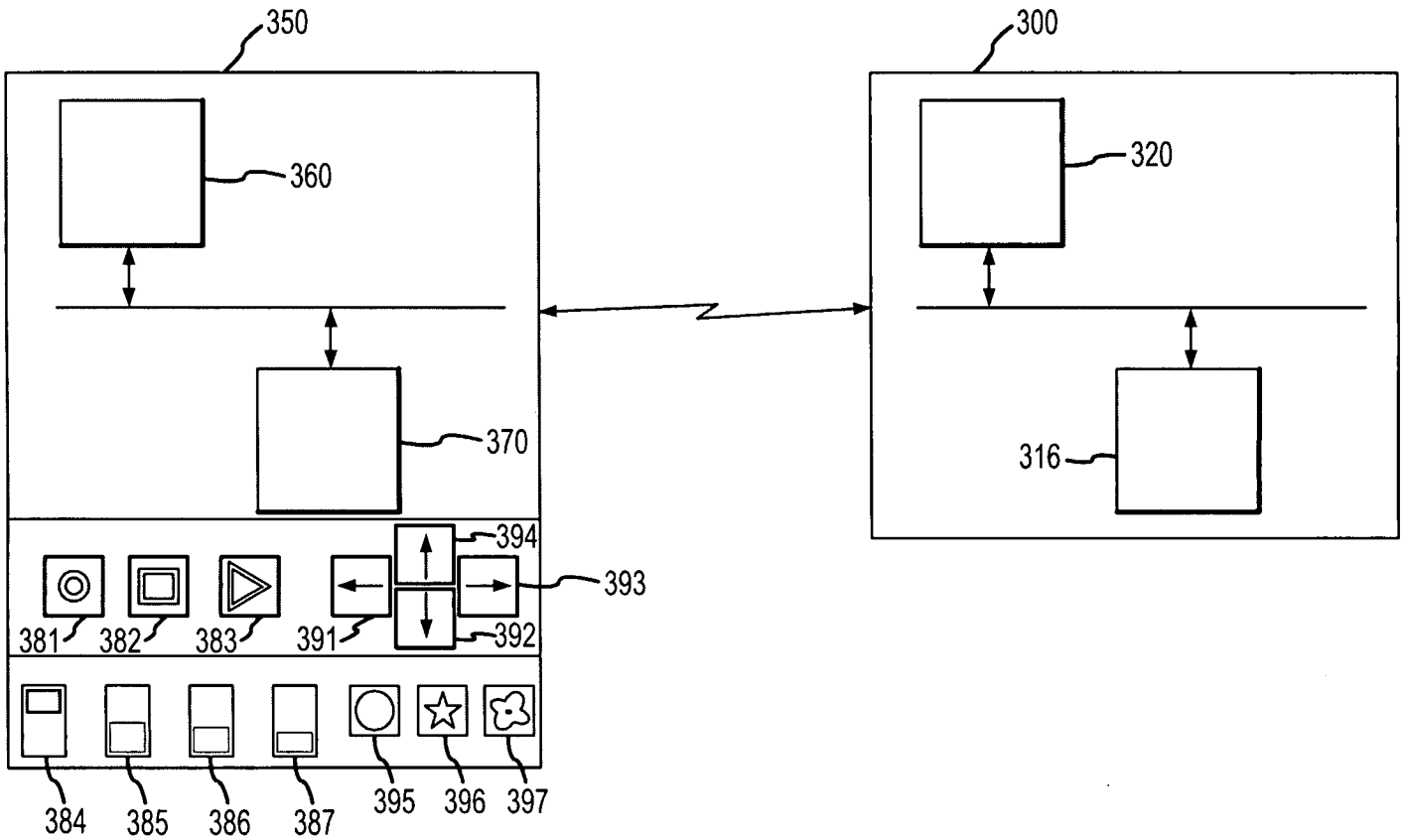
FIG. 3 illustrates another embodiment of a remote controlled transmitter and receiver in accordance with one embodiment of the invention.

FIG. 3 illustrates an example of a transmitter and receiver combination in accordance with yet another embodiment of the invention. FIG. 3 illustrates a transmitter 350 for transmitting signals to receiver 300. The double headed arrow between transmitter and receiver represents signals from at least the transmitter to the receiver; however, signals could also be sent from the receiver to the transmitter in some embodiments if the receiver is also equipped with transmitting capability and the transmitter 350 is equipped with receiving capability. Transmitter 350 is shown as having a processor 360 coupled with a memory 370 via a bus. Similarly, receiver 300 is shown having a processor 320 coupled with memory 316 via a bus. The transmitter can be equipped with a variety of controllers. For example, control buttons 391, 392, 393, 394 can be utilized by a user to control the movement of a drawing vehicle such as a self-powered car. Alternatively, the controller could take the form of a steering wheel or gimbaled stick as one of ordinary skill in the art would understand from other toy designs. In addition, control switches 384, 385, 386, and 387 can be utilized for controlling the position of multiple drawing implement holders on the drawing vehicle. For example, switch 384 illustrates a switch in the "engaged" position wherein the corresponding drawing implement holder on the drawing vehicle is in a position so as to cause the drawing implement that it is holding to engage a drawing surface. However, switches 385, 386, and 387 are in the "non-engaged" position so that their corresponding drawing implement holders are not causing their corresponding drawing implements to engage the drawing surface. This can be understood with reference to FIG. 9B, for example.

The embodiment shown in FIG. 3 illustrates controls that a user can use to store a design sequence. For example, by engaging button 381 to record a series of control commands, the transmitter 350 can store an initial as well as subsequent commands transmitted to receiver 300. Once button 382 is engaged to stop the recording, the storage of the subsequent commands can stop. The commands can later be played back by engaging control 383 so that the stored series of commands can then be retransmitted to the drawing vehicle. The sequence of commands can be stored in memory 370. Alternatively, if the receiver is equipped with memory as shown on FIG. 3 where memory 316 is provided, then the sequence of commands can be stored in memory 316. Thus, it is optional as to where the sequence of commands is actually stored.

In addition, a drawing vehicle can be programmed with pre-programmed designs that a child can utilize in creating his or her artwork. For example, a flower design could be stored in the memory of the transmitter and receiver and activated. Then, the child could activate that design by activating a control on the transmitter, such as control button 397, or even on the receiver so as to cause the pre-programmed design to be implemented. Similarly, control buttons 395 and 396 can be used to activate pre-programmed circles and flowers, respectively.

Figure 4:
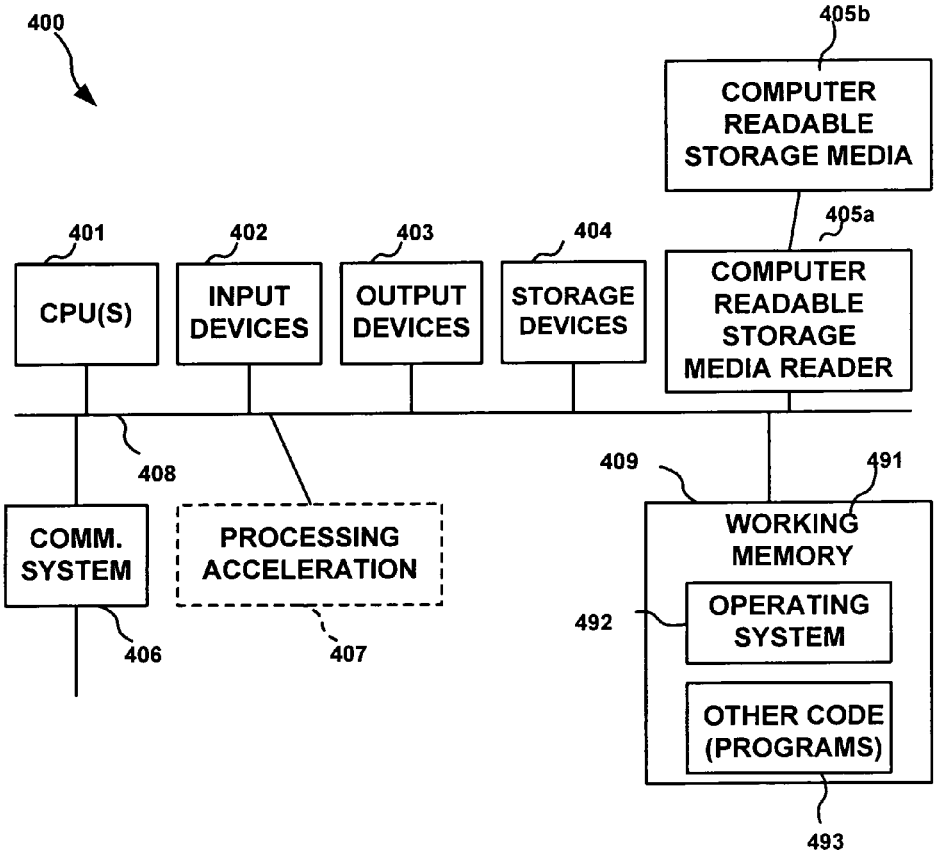
FIG. 4 illustrates a block diagram of a computing device that can be utilized for a transmitter and/or receiver in one embodiment of the invention.

FIG. 4 broadly illustrates how individual computing elements can be implemented. System 400 is shown comprised of hardware elements that are electrically coupled via bus 408, including a processor 401, input device 402, output device 403, storage device 404, computer-readable storage media reader 405*a*, communications system 406 processing acceleration (e.g., DSP or special-purpose processors) 407 and memory 409. Computer-readable storage media reader 405*a* is further coupled to computer-readable storage media 405*b*, the combination comprehensively representing remote, local, fixed and/or removable storage devices plus storage media, memory, etc. for temporarily and/or more permanently containing computer-readable information, which can include storage device 404, memory 409 and/or any other such accessible system 400 resource. System 400 also comprises software elements (shown as being currently located within working memory 491) including an operating system 492 and other code 493, such as programs, applets, data and the like.

System 400 has extensive flexibility and configurability. Thus, for example, a single architecture might be utilized to implement one or more servers that can be further configured in accordance with currently desirable protocols, protocol variations, extensions, etc. However, it will be apparent to those skilled in the art that embodiments may well be utilized in accordance with more specific application requirements. For example, one or more system elements might be implemented as sub-elements within a system 400 component (e.g. within communications system 406). Customized hardware might also be utilized and/or particular elements might be implemented in hardware, software (including so-called "portable software," such as applets) or both. Further, while connection to other computing devices such as network input/output devices (not shown) may be employed, it is to be understood that wired, wireless, modem and/or other connection or connections to other computing devices might also be utilized. Not all system 400 components will necessarily be required in all cases.

Figure 5:
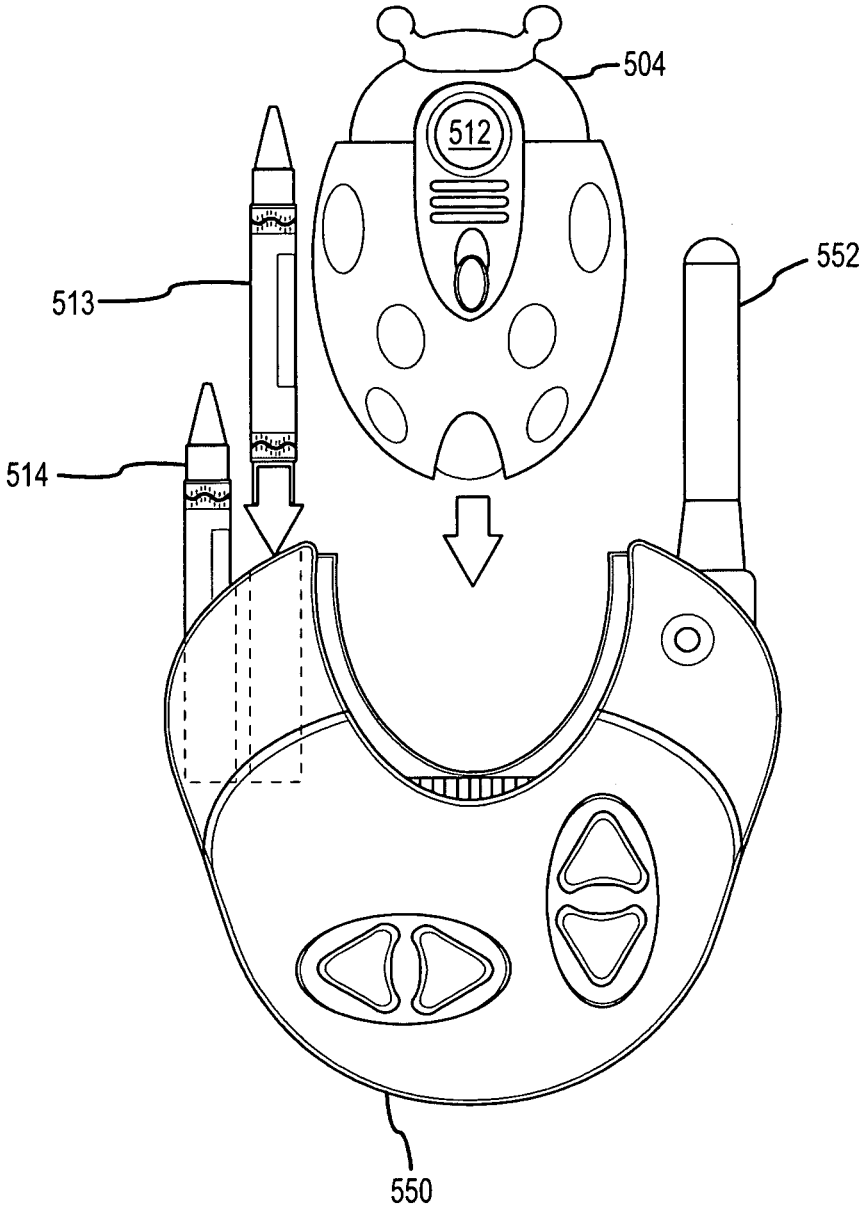
FIG. 5 illustrates an embodiment of a remote controlled drawing vehicle wherein the controller also serves as a charger for the drawing vehicle, according to one embodiment of the invention.

Referring now to FIG. 5 an example of a drawing vehicle and controller can be seen. In FIG. 5 a controller 550 is provided with an on/off switch and control buttons. The arrow shaped buttons shown on controller 550 allow a user to control the movement of the drawing vehicle 504. An antenna 552 is provided for transmission of signals to the receiver of drawing vehicle 504. In addition, the controller is shown as having drawing implement storage holders for drawing implements. In FIG. 5 the drawing implements being stored are crayons 513 and 514. In accordance with one embodiment, the drawing vehicle can be configured so as to engage a charging receptacle on controller 550. Thus, controller 550 can serve as both a controller during use of the toy as well as a charger when the toy is not in use. As shown by the arrow in FIG. 5, the drawing vehicle 504 can be pushed into a charging receptacle to perform the charging operation. The charging unit can be powered from an AC power supply during the charging process.

Drawing vehicle 504 is also shown with a drawing implement holder 512. This drawing implement holder is essentially a clamp in the drawing vehicle. The shape of the clamp can be controlled via a slide button disposed on the drawing vehicle. Thus, the size of the clamp can be increased for a marker, for example, and decreased for a smaller drawing implement, such as a crayon. The downward force on the drawing implement can be implemented via a ratchet mechanism that is incrementally activated so as to incrementally cause the drawing implement to be forced downward. This is particularly true for use with a piece of chalk or crayon. It may not be necessary for a drawing implement such as a marker. As the device rolls across the drawing surface, the axle of the wheels can be coupled with the ratchet mechanism so as to move the drawing implement towards the drawing surface after a predetermined travel distance of the drawing vehicle. Thus, one can estimate how often or how much to move the drawing implement towards the drawing surface during travel of the drawing vehicle and configure the ratchet mechanism accordingly.

Figure 6A:
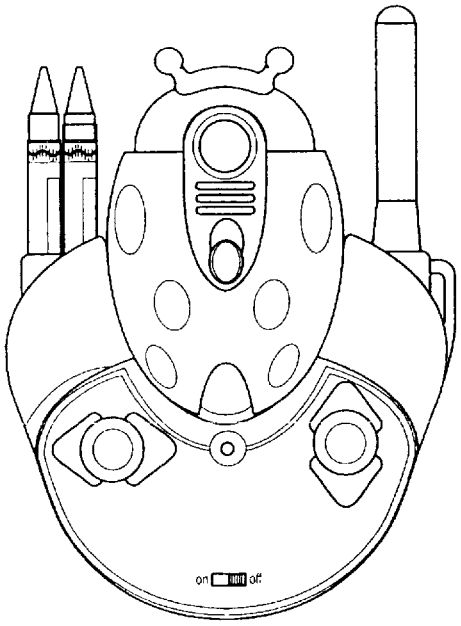
FIG. 6A illustrates a top view of a remote controlled drawing vehicle disposed in a charging/control unit, in accordance with one embodiment of the invention.
Figure 6B:
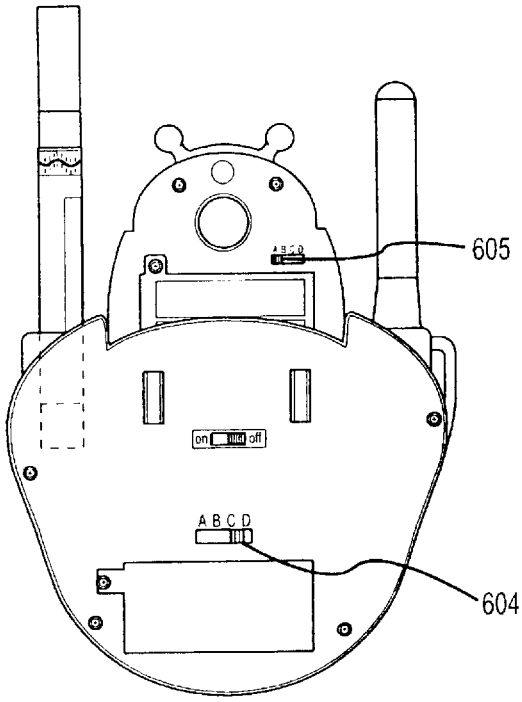
FIG. 6B illustrates a rear view of the device shown in FIG. 6A, but with a marker being held by the charging unit rather than crayons, in accordance with one embodiment of the invention.

FIGS. 6A and 6B illustrate top and bottom views of the remote controlled device shown in FIG. 5. Namely, FIG. 6A shows the drawing vehicle in an engaged position with the controller. FIG. 6A also shows the controller as storing two crayons for positioning within the drawing vehicle. FIG. 6B illustrates a rear view of the controller and drawing vehicle. FIG. 6B also illustrates that the controller can store a marker. FIG. 6B further illustrates that the controller can be equipped with a switch 604 that allows a variety of frequencies to be used for the toy. A similar switch 605 allows the drawing vehicle to be set to a corresponding frequency so that the controller and the drawing vehicle can be in communication. Such frequencies are especially beneficial when multiple remote controlled toys are being use in proximity to one another. This prevents a transmission from the controller of one toy from being received inadvertently by a second toy. FIG. 6B also shows compartments on the drawing vehicle and controller for housing power supplies, such as batteries.

Figure 7A:
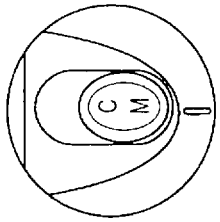
FIG. 7A illustrates a selector for selecting the size of the drawing implement holder used in FIGS. 7B and 7C, according to one embodiment of the invention.
Figure 7B:
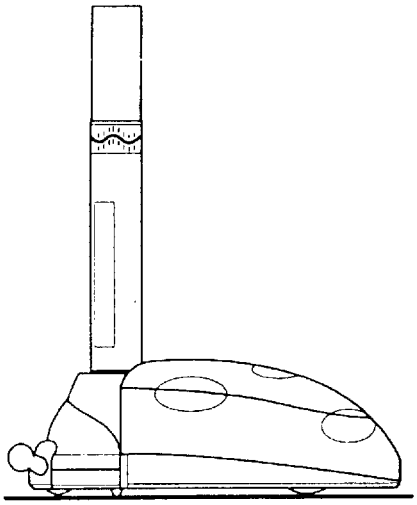
FIG. 7B illustrates a drawing vehicle holding a marker, according to one embodiment of the invention.
Figure 7C:
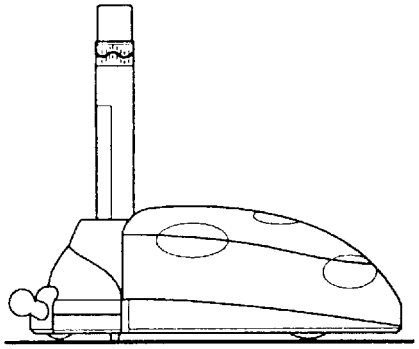
FIG. 7C illustrates a drawing vehicle holding a crayon, according to one embodiment of the invention.

FIGS. 7A, 7B, and 7C illustrate an example of how the clamp switch can be utilized to provide an orifice for different sized drawing implements. For example, FIG. 7A illustrates a slideable switch between a crayon and a marker position. FIG. 7B illustrates a drawing vehicle as holding a marker, while FIG. 7C illustrates the same drawing vehicle as holding a smaller shaped crayon. This can be accomplished by allowing the slideable switch shown in FIG. 7A to cause a change in size of the clamp that holds the drawing implement.

Figure 8A:
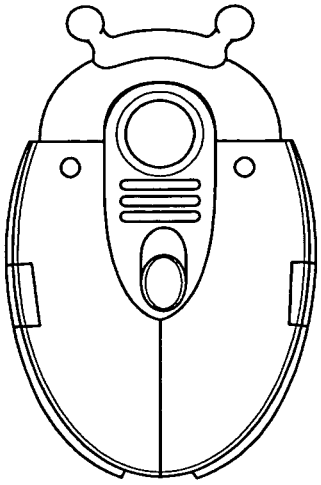
FIG. 8A illustrates a top view of a drawing vehicle without a shell covering, according to one embodiment of the invention.
Figure 8B:
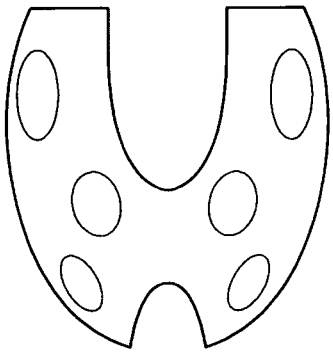
FIG. 8B illustrates a shell covering according to one embodiment of the invention.
Figure 8C:
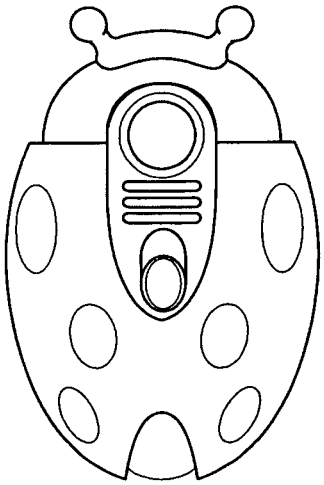
FIG. 8C illustrates the drawing vehicle shown in FIG. 8A with the shell covering of FIG. 8B installed, according to one embodiment of the invention.

FIGS. 8A, 8B, and 8C illustrate an example of a drawing vehicle with a removable and replaceable shell or cover. As a toy, it may be desirable for a family with several children to be able to reconfigure the toy to a child's preference. For example, different shell coverings could be patterned with different artwork, such as a flower design, a bug design, an animal design, etc. FIG. 8A illustrates a drawing vehicle with the removable shell removed. FIG. 8B illustrates an example of a removable shell having a ladybug design. FIG. 8C illustrates the drawing vehicle from FIG. 8A coupled with the removable shell from FIG. 8B.

Figure 9B:
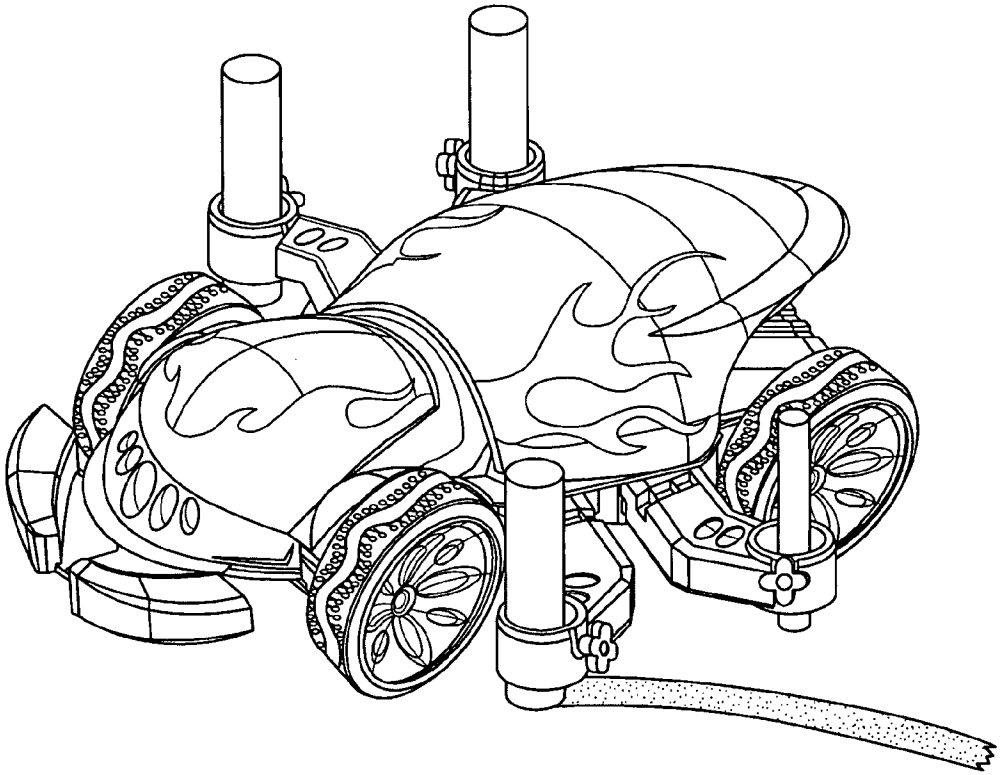
FIG. 9B illustrates a drawing vehicle with multiple drawing implement holders, according to one embodiment of the invention.
Figure 9A:
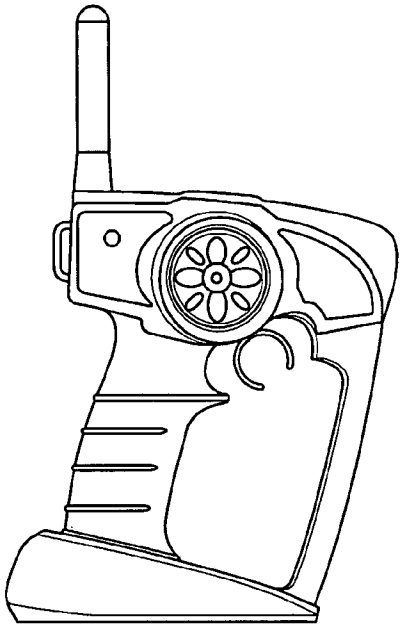
FIG. 9A illustrates a control transmitter according to one embodiment of the invention.

Referring now to FIGS. 9A and 9B, another embodiment of a remote controlled toy drawing vehicle can be seen. FIG. 9A illustrates a pistol grip controller that can be used to transmit control signals to the drawing vehicle in FIG. 9B. FIG. 9B illustrates a drawing vehicle having drawn a partial design with its front port arm. Notably, the rear port arm has the corresponding drawing implement in a raised position so as not to have drawn on the drawing surface. According to one embodiment of the invention, the controller can be used to control different drawing implement holders so as to cause their respective drawing implements to engage or not to engage the drawing surface, respectively.

Figure 10:
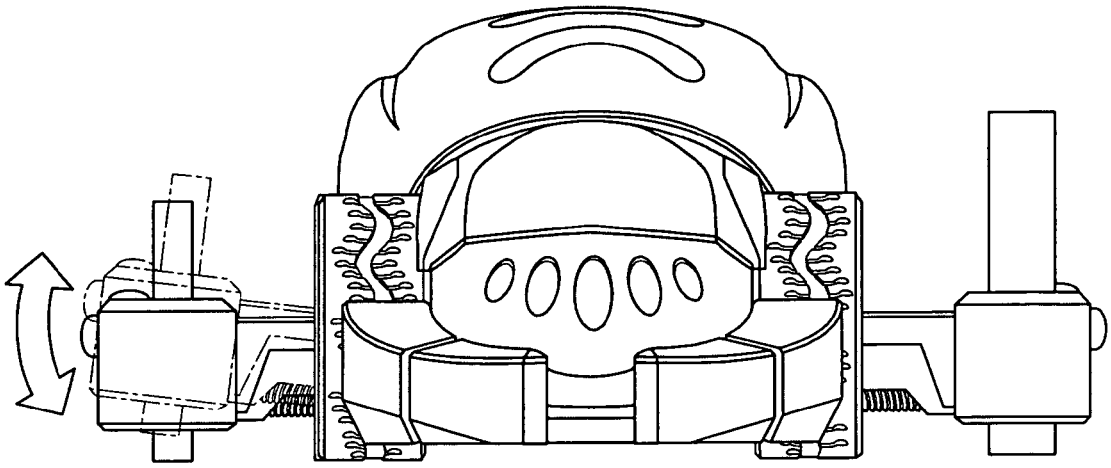
FIG. 10 illustrates a front view of a drawing vehicle with engageable drawing implement holders that can position a drawing implement in contact with a drawing surface as well as out of contact with a drawing surface, according to one embodiment of the invention.

FIG. 10 illustrates a front view of a drawing vehicle, according to one embodiment of the invention. As can be seen by the double headed arrow, the drawing implement holder can be raised and lowered. This embodiment shows a spring activated drawing implement holder. The spring is coupled with one end of the drawing implement holder as well as the body of the drawing vehicle. The spring force of the spring forces the end of the drawing implement holder towards the drawing surface. This can be accomplished by coupling the drawing implement holder via a hinged coupling at the end of the drawing implement holder that is proximate to the drawing vehicle. The spring can be coupled to the drawing vehicle and to the distal end of the drawing implement holder. Thus, the spring force pulls the distal end of the drawing implement holder downward while rotating the near end of the drawing implement holder about the hinge.

Figure 11A:
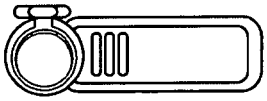
FIG. 11A illustrates a top view of a drawing implement holder in accordance with one embodiment of the invention.
Figure 11B:
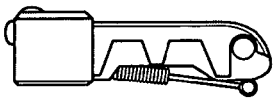
FIG. 11B illustrates a side view of a drawing implement holder in accordance with one embodiment of the invention.

FIGS. 11A and 11B illustrate a top view and side view of one embodiment of a drawing implement holder. FIG. 11A shows that the drawing implement holder can be provided with a clamp mechanism that can be closed via a screw driven control. The screw driven control can expand or contract the circumference of the clamp so as to accommodate different sized drawing implements. FIG. 11B illustrates a side view of the drawing implement holder shown in FIG. 11A and further illustrates the spring activated drawing surface engagement mechanism.

FIG. 12 illustrates a top view of a drawing vehicle having a configuration of a spider. Also shown in FIG. 12 are clamped drawing implements. In this embodiment, the end of the screw serves to force the drawing implement against the inner surface of the drawing implement holder so as to mechanically hold the drawing implement in place. Also shown in FIG. 12 are wheels on the drawing vehicle. In addition to or in place of the drawing implement holders, the wheels of the drawing vehicle can be utilized to perform the drawing on the drawing surface. Namely, this can be accomplished by configuring the wheels with chalk or ink or even crayon.

FIG. 13 illustrates a top view of a wheel with a patterned design. An internal layer can be configured from chalk and as the wheel turns the chalk dust can be transmitted to the tread design for disposition on the drawing surface.

FIG. 14 illustrates a wheel configured from different layers, such as a plastic or rubber outer layer and an intermediate chalk layer over a core layer. Alternatively, the wheel could be comprised substantially of chalk without an outer tread layer.

Referring to FIG. 12 again, the drawing vehicle and drawing implement holder arms can be configured so as to allow the arms to be retractable. In larger units, this can easily be accomplished by creating a tabbed arm for example that provides an intermediate position as well as switching to a retracted position.

Figure 15:
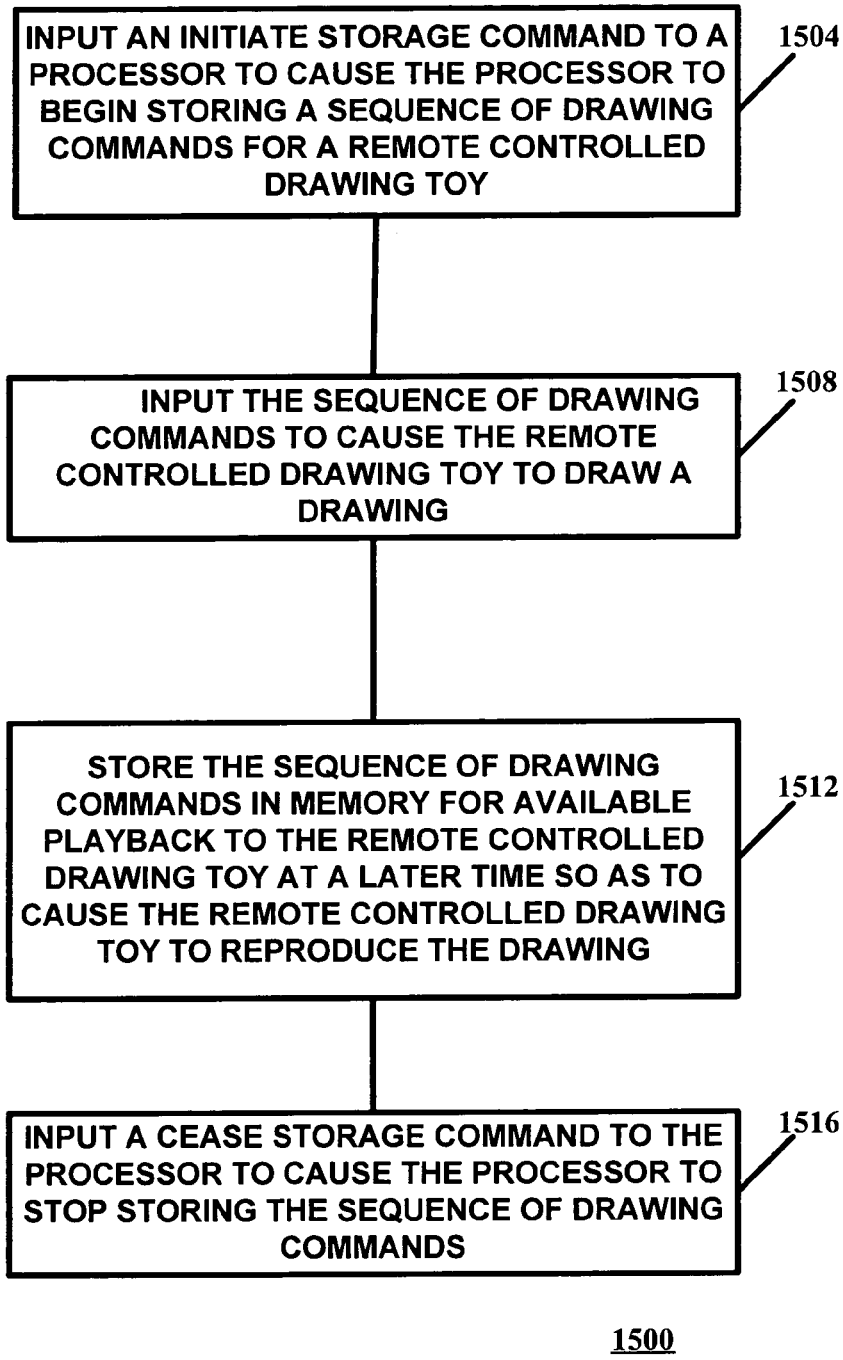
FIG. 15 illustrates a flowchart demonstrating a method of remote controlled drawing in accordance with one embodiment of the invention.

Referring now to FIG. 15, a flowchart 1500 demonstrating a method of utilizing a remote controlled drawing vehicle can be seen. In block 1504 one can input an "initiate storage" command to a processor to cause the processor to begin storing a sequence of drawing commands for a remote controlled drawing toy. Furthermore, in block 1508, one can implement a sequence of drawing commands to cause the remote controlled drawing toy to draw a drawing. Block 1512 shows that the sequence of drawing commands can be stored in memory for available playback to the remote controlled drawing toy at a later time so as to cause the remote controlled drawing toy to reproduce the recorded drawing. In block 1516, one can input a cease storage command to the processor to cause the processor to stop storing the sequence of drawing commands.

Figure 16A:
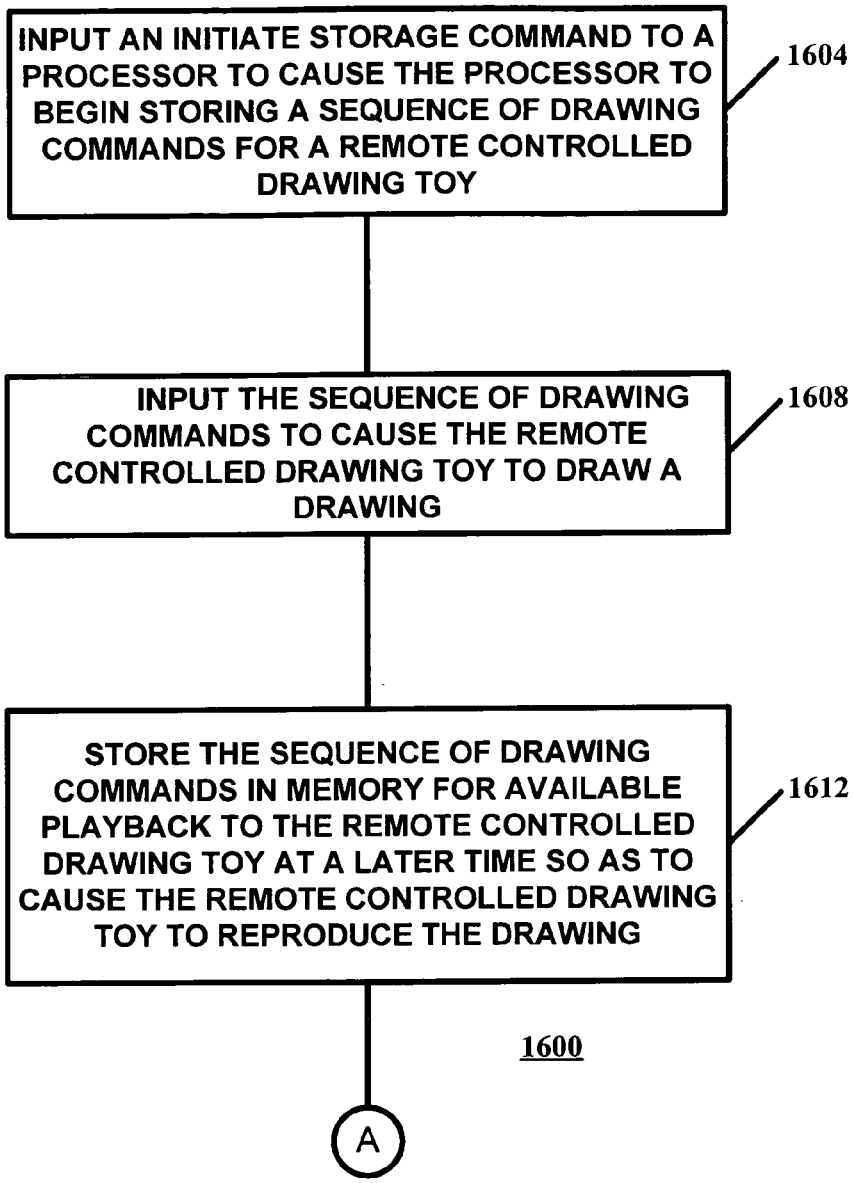
FIGS. 16A and 16B illustrate a flowchart demonstrating a method of remote controlled drawing in accordance with one embodiment of the invention.
Figure 16B:
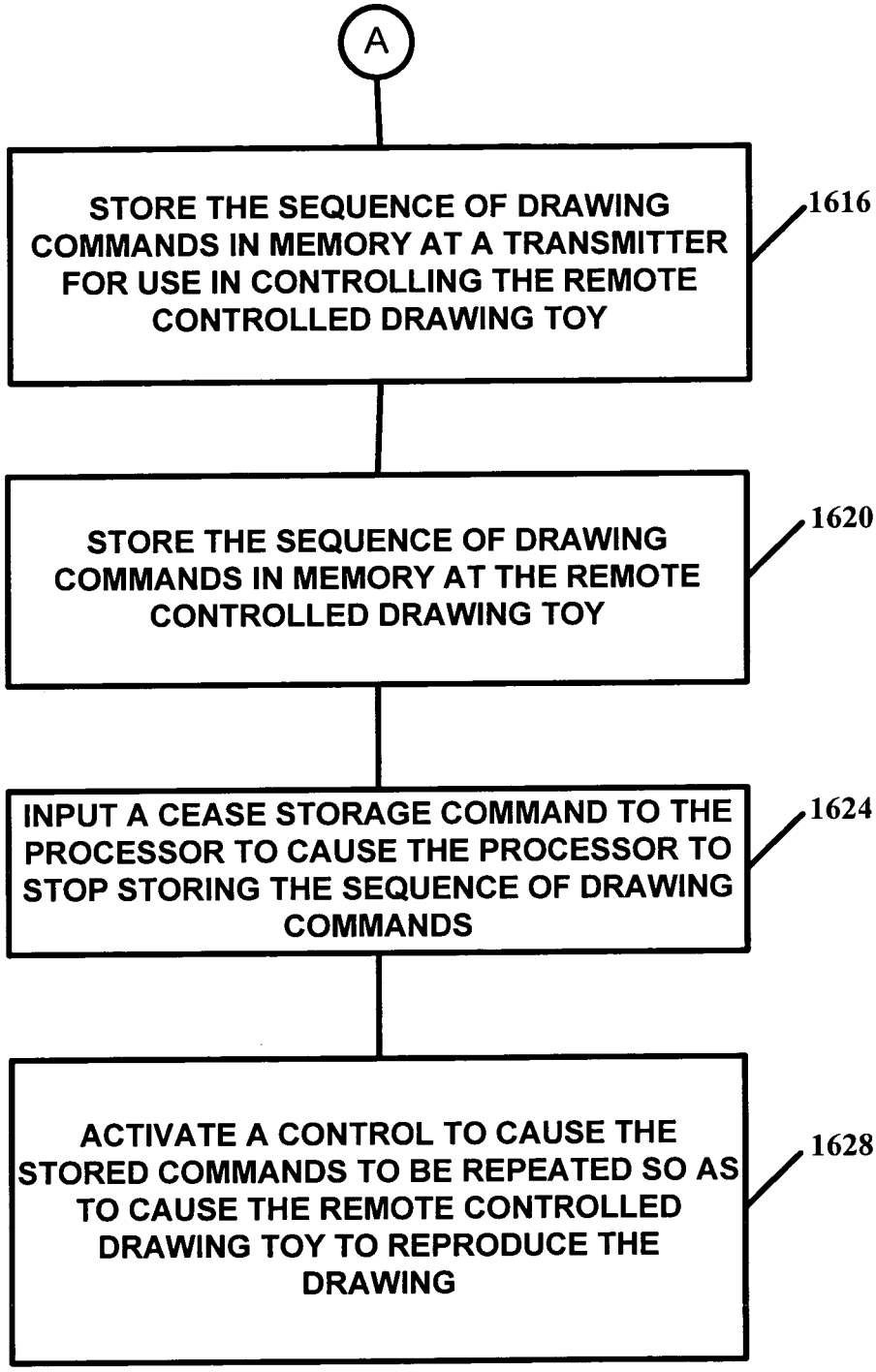

FIGS. 16A and 16B illustrate a more detailed flowchart 1600 of that shown in FIG. 15. Namely block 1604 shows that one can input an "initiate storage" command to a processor to cause the processor to begin storing a sequence of drawing commands for a remote controlled drawing toy. In block 1608, one can input the sequence of drawing commands to cause the remote control drawing toy to draw a drawing. One can store the sequence of drawing commands in memory for available playback to the remote controlled drawing toy at a later time so as to cause the remote controlled drawing toy to reproduce the drawing, as shown in block 1612. The sequence of drawing commands can be stored in memory at a transmitter for use in controlling the remote controlled drawing toy as shown by block 1616 or the sequence of drawing commands can be stored in memory at the remote controlled drawing toy as shown by block 1620. Either or both storage locations is possible. One can input a "cease storage" command to the processor to stop storing the sequence of drawing commands as shown by block 1624. In block 1628 one can activate a control to cause a stored command to be repeated so as to cause the remote controlled drawing toy to reproduce the drawing.

Figure 17:
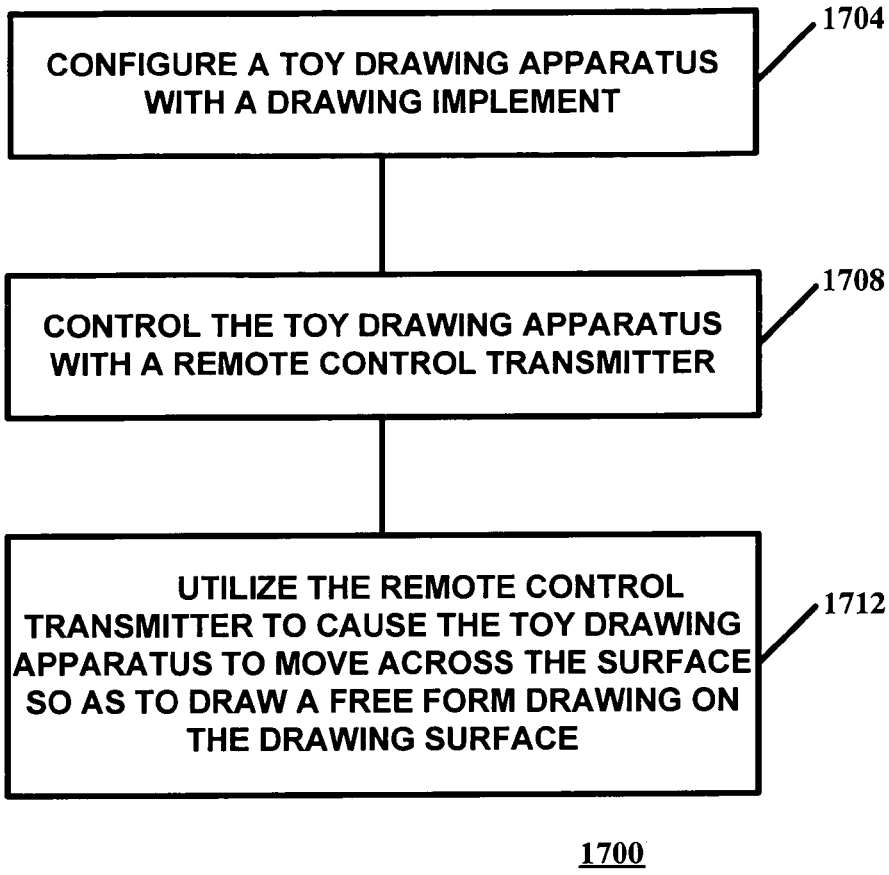
FIG. 17 illustrates a flowchart demonstrating a method of free form drawing with a toy drawing apparatus in accordance with one embodiment of the invention.

FIG. 17 illustrates a flowchart 1700 demonstrating a method of utilizing the drawing toy to prepare a drawing. In block 1704 one can configure the toy drawing apparatus with a drawing implement. Block 1708 shows that one can control the toy drawing apparatus with a remote controlled transmitter. In block 1712 one can use the remote controlled transmitter to cause the toy drawing apparatus to move across a drawing surface so as to draw a free form drawing on the drawing surface.

Figure 18:
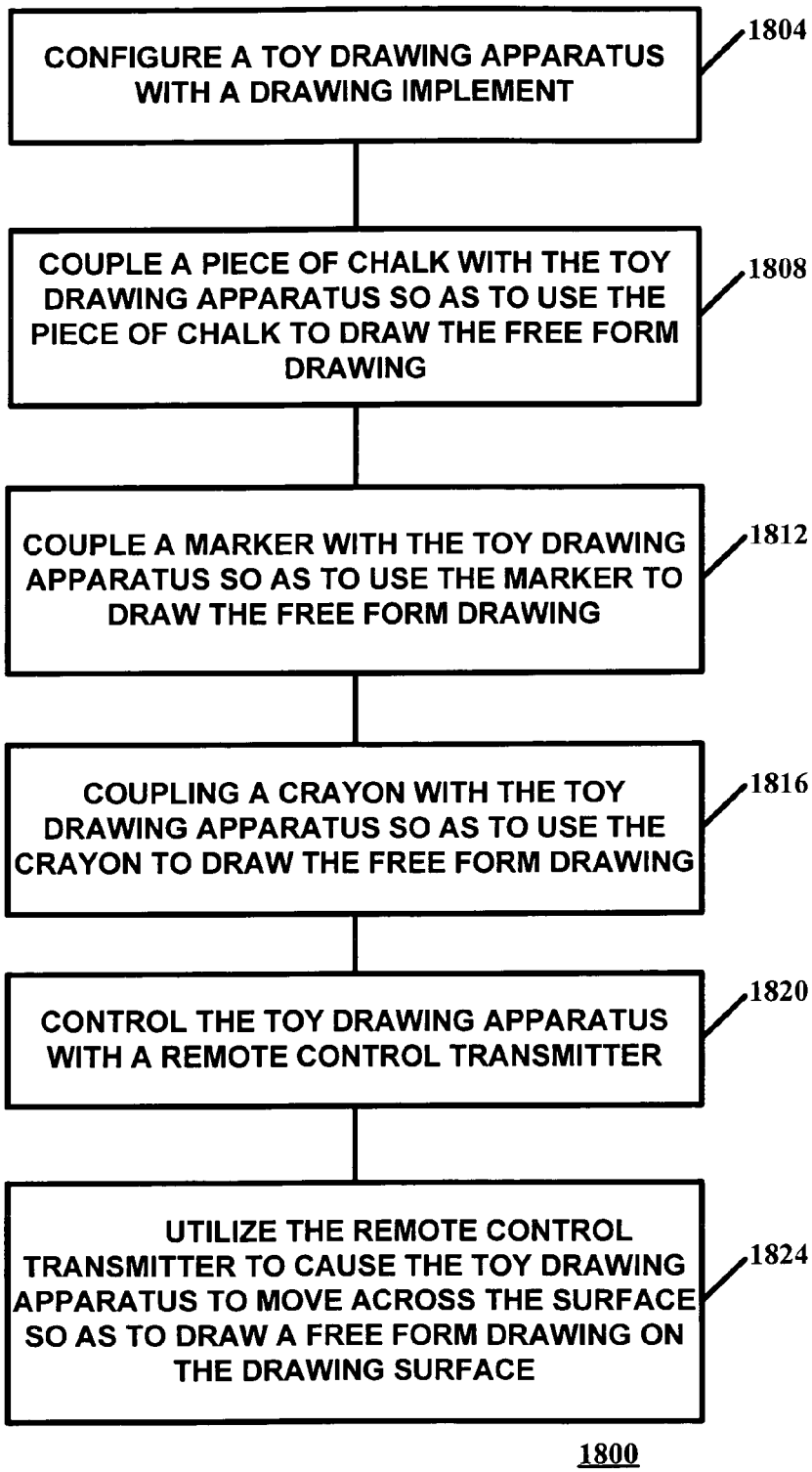
FIG. 18 illustrates a flowchart demonstrating a method of remote controlled drawing with a remote controlled drawing apparatus in accordance with one embodiment of the invention.

FIG. 18 illustrates a more detailed flowchart from that shown in FIG. 17. Namely, flowchart 1800 illustrates in block 1804 that one can configure a toy drawing apparatus with a drawing implement. For example, one can couple a piece of chalk with the toy drawing apparatus so as to use the piece of chalk to draw a free form drawing, as shown in block 1808. Similarly, one can couple a marker with the toy drawing apparatus so as to use the marker to draw the free form drawing as shown by block 1812. In addition, one could also couple a crayon with the toy drawing apparatus so as to use the crayon to draw the free form drawing as shown in block 1816. In block 1820, one may control the toy drawing apparatus with a remote control transmitter. Block 1824 illustrates that the remote control transmitter may be utilized to cause the toy drawing apparatus to move across the surface so as to draw a free form drawing on the drawing surface.

The toy drawing apparatus can be utilized on multiple drawing surfaces. For example, a child could utilize the toy outside on a sidewalk or driveway with water soluble chalk that can be washed away with a hose or by rain. Similarly, one could couple a crayon to the drawing vehicle and use the drawing vehicle to draw on a large sheet of art paper. Such drawing could take place either outdoors or indoors. Similarly, the drawing vehicle could be equipped with markers as the drawing implements and utilized on drawing paper either outdoors or indoors.

Through the use of a transmitter a child can actively participate in the drawing by actually standing on the drawing surface while creating the art. Furthermore, free form drawing can be implemented so as to allow the drawing vehicle to cross over previously created lines and designs after they have initially been created.

The drawing vehicle can be configured in a variety of kit forms for assembly in the field. For example, the drawing vehicle can be manufactured as a separate unit but sold with different types of drawing implements, such as crayons, chalk, markers, etc. Multiple colors for drawing implements can be provided so as to allow different colored designs to be created. In addition to being provided with drawing implements, the drawing vehicle can also be provided with the controller as part of the kit and the controller as shown in some embodiments herein can be configured to serve as a charger. Alternatively, a separate charger can be provided in kit form with the drawing vehicle or a battery unit could also be provided. Once provided, the drawing vehicle can be assembled with the drawing implements and if necessary a removable power supply such as batteries.

In addition, one might also utilize a paint supply or ink supply and brush or jet the paint or ink onto the drawing surface via an applicator.

While various embodiments of the invention have been described as methods or apparatus for implementing the invention, it should be understood that the invention can be implemented through code coupled to a computer, e.g., code resident on a computer or accessible by the computer. For example, software could be utilized to implement many of the methods discussed above. Thus, in addition to embodiments where the invention is accomplished by hardware, it is also noted that these embodiments can be accomplished through the use of an article of manufacture comprised of a computer usable medium having a computer readable program code embodied therein, which causes the enablement of the functions disclosed in this description. Therefore, it is desired that embodiments of the invention also be considered protected by this patent in their program code means as well. Furthermore, the embodiments of the invention may be embodied as code stored in a computer-readable memory of virtually any kind including, without limitation, RAM, ROM, magnetic media, optical media, or magneto-optical media. Even more generally, the embodiments of the invention could be implemented in software, or in hardware, or any combination thereof including, but not limited to, software running on a general purpose processor, microcode, PLAs, or ASICs.

It is also envisioned that embodiments of the invention could be accomplished as computer signals embodied in a carrier wave, as well as signals (e.g., electrical and optical) propagated through a transmission medium. Thus, the various information discussed above could be formatted in a structure, such as a data structure, and transmitted as an electrical signal through a transmission medium or stored on a computer readable medium.

It is also noted that many of the structures, materials, and acts recited herein can be recited as means for performing a function or steps for performing a function. Therefore, it should be understood that such language is entitled to cover all such structures, materials, or acts disclosed within this specification and their equivalents.

It is thought that the apparatuses and methods of the embodiments of the present invention and its attendant advantages will be understood from this specification. While the above is a complete description of specific embodiments of the invention, the above description should not be taken as limiting the scope of the invention as defined by the claims.

What is claimed is:

1. A toy for drawing comprising:

a self-powered body;

at least one drawing implement holder coupled with said self-powered body and configured to cause a drawing implement to contact a drawing surface while said drawing implement is being held by said drawing implement holder during operation of said toy on said drawing surface;

a receiver coupled with said self-powered body and configured to receive a sequence of drawing commands from a remote transmitter for controlling said self-powered body;

wherein said receiver coupled with said self-powered body is configured to cause said toy to draw a free-form design during operation solely in response to said sequence of drawing commands received from said remote transmitter; and a memory coupled with said receiver for storing the sequence of drawing commands for available playback at a later time so as to cause the remote controlled drawing toy to reproduce the free-form design.

2. The toy as claimed in claim 1 wherein said drawing implement holder is retractably coupled with said self-powered body so as to allow said drawing implement holder to be substantially retractable within said body.

3. The toy as claimed in claim 1 wherein said drawing implement holder comprises:

a chalk holder.

4. The toy as claimed in claim 1 wherein said drawing implement holder comprises:

a crayon holder.

5. The toy as claimed in claim 1 wherein said drawing implement holder comprises:

a marker holder.

6. The toy as claimed in claim 1 wherein said drawing implement holder comprises:

a chalk wheel holder.

7. The toy as claimed in claim 1 wherein said drawing implement holder comprises:

a clamp configured for holding a piece of chalk.

8. The toy as claimed in claim 1 wherein said drawing implement holder comprises:

a clamp configured for holding a crayon.

9. The toy as claimed in claim 1 wherein said drawing implement holder is configured to apply a force to said drawing implement so as to force said drawing implement to contact said drawing surface during use.

10. The toy as claimed in claim 9 and further comprising a spring to apply said force.

11. The toy as claimed in claim 1 wherein said self-powered body comprises:

a removable shell cover.

12. The toy as claimed in claim 1 wherein said receiver is configured to receive signals transmitted at different frequencies.

13. The toy as claimed in claim 12 and further comprising:

a switch coupled with said receiver and configured to select a frequency of operation so as to allow the receiver to receive said signals transmitted at said different frequencies.

14. The toy as claimed in claim 1 wherein said at least one drawing implement holder is one of a plurality of drawing implement holders coupled with said self-powered body.

15. The toy as claimed in claim 14 wherein at least two of said drawing implement holders operate as independently operable drawing implement holders so as to allow one of said independently operable drawing implement holders to maintain a first drawing implement in contact with said drawing surface during operation while said other independently operable drawing implement holder maintains a second drawing implement out of contact with said drawing surface during said operation.

16. The toy as claimed in claim 1 wherein said drawing implement holder is configured to be moved from a position that causes said drawing implement to engage said drawing surface to a position that causes said drawing implement to not engage said drawing surface during use.

17. A method of free form drawing on a drawing surface, said method comprising:

providing a toy drawing apparatus with a drawing implement in contact with the drawing surface;

controlling said toy drawing apparatus with a remote control transmitter;

utilizing said remote control transmitter to transmit a sequence of drawing commands to a receiver associated with the toy drawing apparatus to cause said toy drawing apparatus to move across said drawing surface solely in response to said sequence of drawing commands to draw a free form drawing on said drawing surface;

providing a memory coupled with said receiver for storing the sequence of drawing commands; and playing back the stored sequence of drawing commands at a later time to cause the remote controlled drawing toy to reproduce the free-form design.

18. The method as claimed in claim 17 and further comprising:

coupling a piece of chalk with said toy drawing apparatus so as to use said piece of chalk to draw said free form drawing.

19. The method as claimed in claim 17 and further comprising:

coupling a marker with said toy drawing apparatus so as to use said marker to draw said free form drawing.

20. The method as claimed in claim 17 and further comprising:

coupling a crayon with said toy drawing apparatus so as to use said crayon to draw said free form drawing.

21. A kit of materials for assembly in the field comprising:

a remote controlled toy vehicle for drawing on a drawing surface, the remote controlled vehicle comprising a receiver and further being configured to receive a sequence of drawing commands from a remote transmitter to cause said toy vehicle to draw a free-form design during operation solely in response to said drawing commands, wherein said remote controlled vehicle further comprises a memory coupled with said receiver for storing the sequence of drawing commands for available playback at a later time to cause the remote controlled vehicle to reproduce the free-form design; and at least one drawing implement for use with said remote controlled toy vehicle;

wherein said drawing implement is configured for holding by said remote controlled vehicle during use in contact with said drawing surface.

* * * * *